US005807450A

United States Patent [19]

Takahashi

[11] Patent Number: 5,807,450

[45] Date of Patent: Sep. 15, 1998

[54] APPARATUS FOR BINDING WIRES OF A WIRE HARNESS

[75] Inventor: Sadao Takahashi, Machida, Japan

[73] Assignee: Molex Incorporated, Lisle, Ill.

[21] Appl. No.: 635,104

[22] Filed: Apr. 19, 1996

[30] Foreign Application Priority Data

Apr. 20, 1995 [JP] Japan ..... 7-119110

[51] Int. Cl.[6] ..... B65H 81/06

[52] U.S. Cl. ..... 156/56; 100/17; 100/27; 156/483

[58] Field of Search ..... 156/53, 56, 468, 156/475, 483, 484, 486; 106/17, 27; 29/755

[56] References Cited

U.S. PATENT DOCUMENTS

| | | | |
|---|---|---|---|
| 2,299,140 | 10/1942 | Hanson | 156/56 X |
| 2,834,499 | 5/1958 | Semkow | 156/486 |
| 2,991,328 | 7/1961 | Lay | 156/56 X |
| 3,108,922 | 10/1963 | Possis et al. | 156/486 X |
| 3,128,214 | 4/1964 | Lay | 156/56 X |
| 3,153,696 | 10/1964 | Blanchard | 156/56 X |
| 3,160,930 | 12/1964 | Fisher | 164/316 |
| 3,168,617 | 2/1965 | Richter | 174/117 FF |
| 3,239,916 | 3/1966 | Love | 29/825 |
| 3,245,860 | 4/1966 | Aurich et al. | 156/486 |
| 3,267,201 | 8/1966 | Pusey et al. | 156/56 X |
| 3,321,352 | 5/1967 | Sejda | 156/486 X |
| 3,389,039 | 6/1968 | Steckler | 156/484 X |
| 3,622,687 | 11/1971 | Doughty | 174/117 |
| 3,955,264 | 5/1976 | Klappert | 29/203 |
| 4,197,348 | 4/1980 | Townsend | 156/56 X |
| 4,290,179 | 9/1981 | Bakermans et al. | 29/33 |
| 4,311,544 | 1/1982 | Salopek | 156/510 |
| 4,360,400 | 11/1982 | Davis et al. | 156/468 |
| 4,457,662 | 7/1984 | Ireland et al. | 414/331 |
| 4,486,253 | 12/1984 | Gonia | 156/51 |
| 4,602,976 | 7/1986 | Fukuda et al. | 156/486 X |
| 4,767,891 | 8/1988 | Biegon et al. | 174/34 |
| 4,838,407 | 6/1989 | Komuro | 198/406 |
| 4,885,838 | 12/1989 | Ruecker et al. | 29/566 |
| 4,923,537 | 5/1990 | Matsushima | 156/48 |
| 4,980,958 | 1/1991 | Suzuki et al. | 29/33 |
| 5,005,611 | 4/1991 | Hecker | 140/147 |
| 5,010,642 | 4/1991 | Takahashi et al. | 29/868 |
| 5,274,195 | 12/1993 | Murphy et al. | 174/117 |
| 5,525,188 | 6/1996 | Ingwersen | 156/539 |

FOREIGN PATENT DOCUMENTS

| | | |
|---|---|---|
| 3-283207 | 12/1991 | Japan . |
| 5-159640 | 6/1993 | Japan . |
| 6-236790 | 8/1994 | Japan . |

*Primary Examiner*—Francis J. Lorin
*Attorney, Agent, or Firm*—Charles S. Cohen

[57] ABSTRACT

An apparatus for binding wires of wire harnesses together which reduces the likelihood of entangling the wires and connector elements of the wire harnesses includes two harness guide rails arranged parallel which guide the opposing connector elements of the wire harness into the apparatus. A wire loading mechanism is disposed beneath and within an open space between the guide rails which collects the wires of the harness which depend thereinto. A taping assembly includes a tape advancement member which is positioned to confront the ejection ends of the guide rails. The wires of the wire harness are gathered together in the form of bundle, and the wire bundle is thereupon urged into contact the adhesive tape so that it may be bound with the tape.

21 Claims, 6 Drawing Sheets

APPARATUS FOR BINDING WIRES OF A WIRE HARNESS

BACKGROUND OF THE INVENTION

The present invention generally relates to a method of and apparatus for binding the electrical wires of a wire harness together, and more particularly relates to a method and apparatus utilizing a single roll of tape for taping a bundle of wires together.

It is common for electrical connector harnesses to be bound manually on an individual basis as they are removed from multi-harness assembly machine. This manual labor cannot be performed at an increased levels which are needed to achieve high-efficiency production. One such manual way of binding the wires of a wire harnesses is to encircle the wires with rubber bands.

Prior art wire harness binding apparatuses are often troubled by entanglement of wires of varying lengths during the binding stage. For example, Japanese Patent Publication No. 6-236790 discloses an apparatus for binding wire harnesses together by taping the opposite ends of the electric wires terminated to connector elements to provide different lots of electric connector harnesses with their wires collected and bound. The wires hang down therefrom in a U-shape.

However, with such an apparatus, the wire harnesses are secured together with their wires bounded together, and therefore, the wires and connector elements of the wire harnesses may become entangled. In such event, it takes a significant amount of time to unbind and separate these tangled wire harnesses from each other at subsequent stages in processing. The binding apparatus disclosed in Japanese Patent Publication No. 6-236790 appears to be primarily directed for use with wire harnesses having wires of the same length, and therefore, if wire harnesses of differing lengths are handled in such a binding apparatus, the wires and connectors of the harnesses are likely to become entangled.

The present invention is therefore directed to a wire taping apparatus and method which avoids the shortcomings of the prior art described above and which offers advantages thereover.

SUMMARY OF THE INVENTION

One object of the present invention is to provide a method of automatically binding the wires of wire harnesses which substantially reduces the likelihood of entangling the wires of the harnesses.

To attain this object, the present invention provides a method of binding the wires of a wire harness together comprising the steps of: orienting the opposing connector elements of the wire harness near each other so as to locate their interconnecting wires in a common location; collecting the wires of the harness together into a bundle; and, applying a wire binding tape to the collected wires by winding the tape therearound.

In another principal aspect of the present invention, a method is provided which includes the steps of: supporting opposing connector elements of the harness within a pair of harness guide rails; aligning opposing connector elements of the wire harnesses with each other by bringing the guide rails close to each other in order to define a space therebetween and underneath the guide rails where the wires of the harness are collected together into a bundle; applying a strip of wire binding tape to the collected wires; and, winding the tape therearound to bind the wires together near the connector elements of the harness.

With the present invention, the opposing connector elements of wire harnesses are oriented toward each other and brought together in order to orient their interconnecting wires so that they hang down from the opposing connector elements of the harnesses. Adhesive tapes of different colors may be used to bind the wires of electric connector harnesses of different lots in order to provide discrimination and facilitate sorting between differing lots of wire harnesses. The adhesive tape which is used for the binding of the wires of the harnesses may be perforated whenever the wires of the wire harness have been bound together.

Advantageously, the present invention binds the hanging wires of each wire harness near the connector elements of the harnesses from which the wires hang, thereby preventing the wires and connector elements of multiple wire harnesses from becoming entangled, even though the wires of sequential harnesses may differ in their lengths.

Another object of the present invention is to provide an automated apparatus for binding wires of wire harnesses without permitting their wires to be entangled.

To attain these and other objects, a wire binding apparatus of the present invention includes two wire harness guide rails arranged parallel to each other and which receive the opposing connector elements of sequential harnesses in an alignment configuration which permits their interconnecting wires to droop down into a predetermined collection area. A loading assembly is provided in the apparatus which is movable toward the exit portion of the wire binding apparatus and is situated below the longitudinal space which occurs between the wire harness guide rails for collecting the wires after they sag between and beneath the guide rails which convey the harness connector elements.

The wire binding apparatus of the present invention may further include a taping assembly confronting the exits of the guide rails, which includes selectively a moveable tape holder and tape advancement components.

One of the two guide rails may be stationary, while the other guide rail may be movable mounted so as to selectively move toward it. Either of the two guide rails may include a wire-collecting spring fixed at its ejection end which cooperates with the wire loading mechanism for collecting the wires of the wire harnesses. The guide rails may also be rotatable about their longitudinal axes so that the openings of the connector element guide slots thereof may be repositioned to facilitate the ejection of taped wired harnesses.

Still further, the tape winding unit may have a perforating unit disposed in the path of the binding tape so that in use, the wires of assembled wire harnesses can be automatically bound without permitting their wires to be entangled.

These and other objects, features and advantages of the present invention will be clearly understood through a consideration of the following detailed description.

BRIEF DESCRIPTION OF THE DRAWINGS

In the course of the following description of the detailed description, reference will be made to the attached drawings wherein like reference numerals identify like parts and wherein.

DETAILED DESCRIPTION OF PREFERRED EMBODIMENTS

Figure 1:
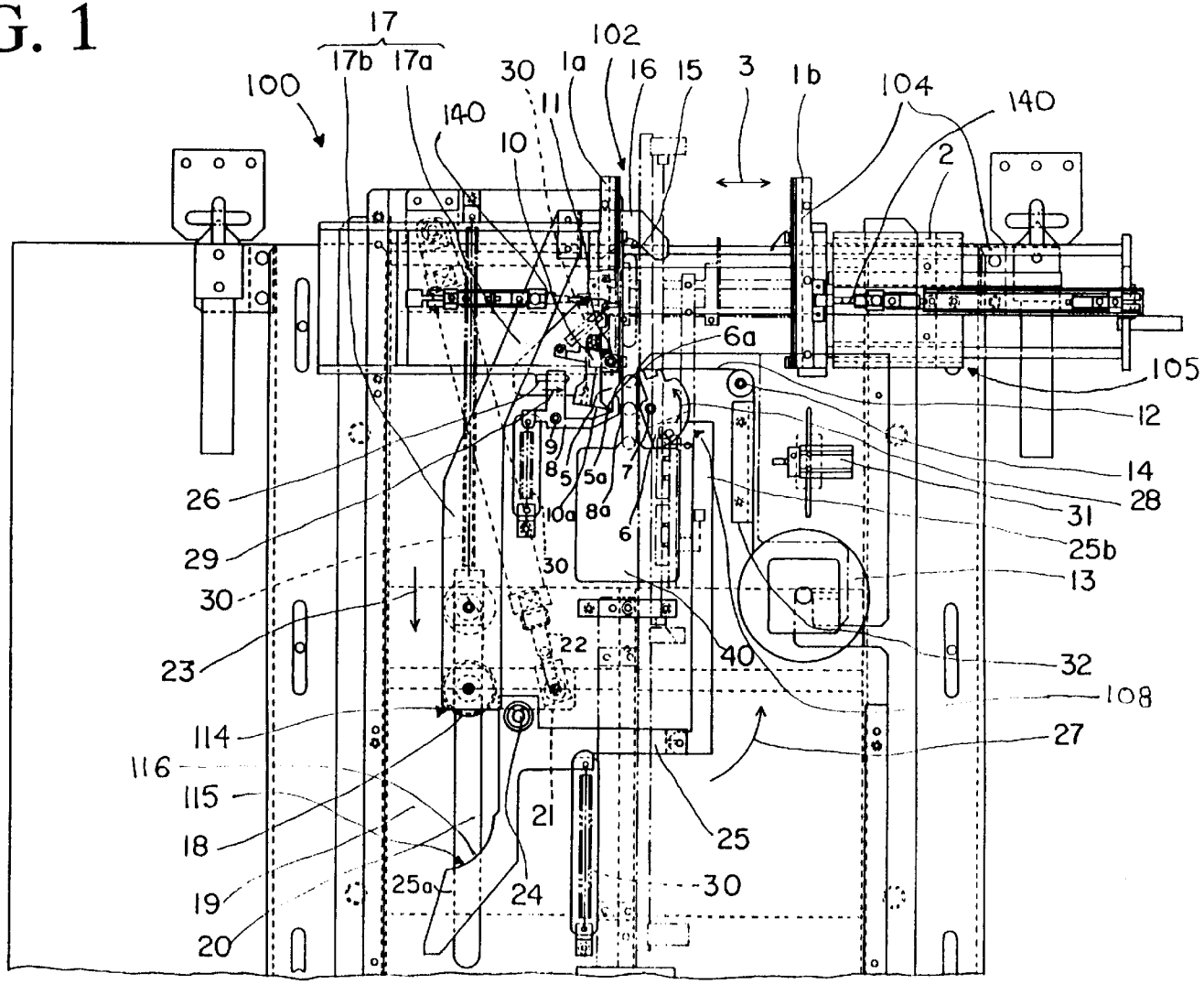
FIG. 1 is a plan view of a wire binding apparatus constructed in accordance with the principles of the present invention.

Referring first to FIG. 1, a wire binding apparatus constructed in accordance with the principles of the present invention is generally illustrated at 100 in plan view. The entrance portion of the apparatus 100 includes a pair of guide rails 1*a* and 1*b*, which form an entryway 102 for wire harnesses to enter the apparatus, that are slidably mounted on the apparatus 100, such as on a series of slider rails 104. The guide rails 1*a*, 1*b* are preferably arranged in an opposing, or confronting, relationship so that one guide rail 1*b* may move toward the other guide rail 1*a* while holding an assembled or terminated wire harness 33 therebetween. The terms "assembled" or "terminated" or "completed" wire harness are used herein to refer to a wire harness of the type generally indicated at 33 in FIG. 2 having a plurality of wires 35 arranged in side-by-side order with single or multiple electrical connector elements 34 terminated to the opposing ends of the wires 35 which make up the harness 33.

As such, it will be understood that the preferred disposition of the wire-binding apparatus 100 of the present invention is in association with a wire harness manufacturing assembly line in which the wire-binding apparatus is positioned downstream of the harness assembly mechanism.

In the specific embodiment 100 illustrated, one of the guide rails 1*a* is held in a stationary position on the apparatus 100, while the other guide rail 1*b* is mounted on one or more transverse slider rails 104. This moveable guide rail 1*b* may be considered as part of an overall carriage assembly 105 which is reciprocatably moved by an associated carriage drive unit 2 along the slider rails 104 either toward and away from the stationary guide rail 1*a* in the directions indicated by arrow 3. The guide rails 1*a*, 1*b* are held in place by movable arms 140 which permit them to be rotated between horizontal and vertical orientations.

Figure 2:
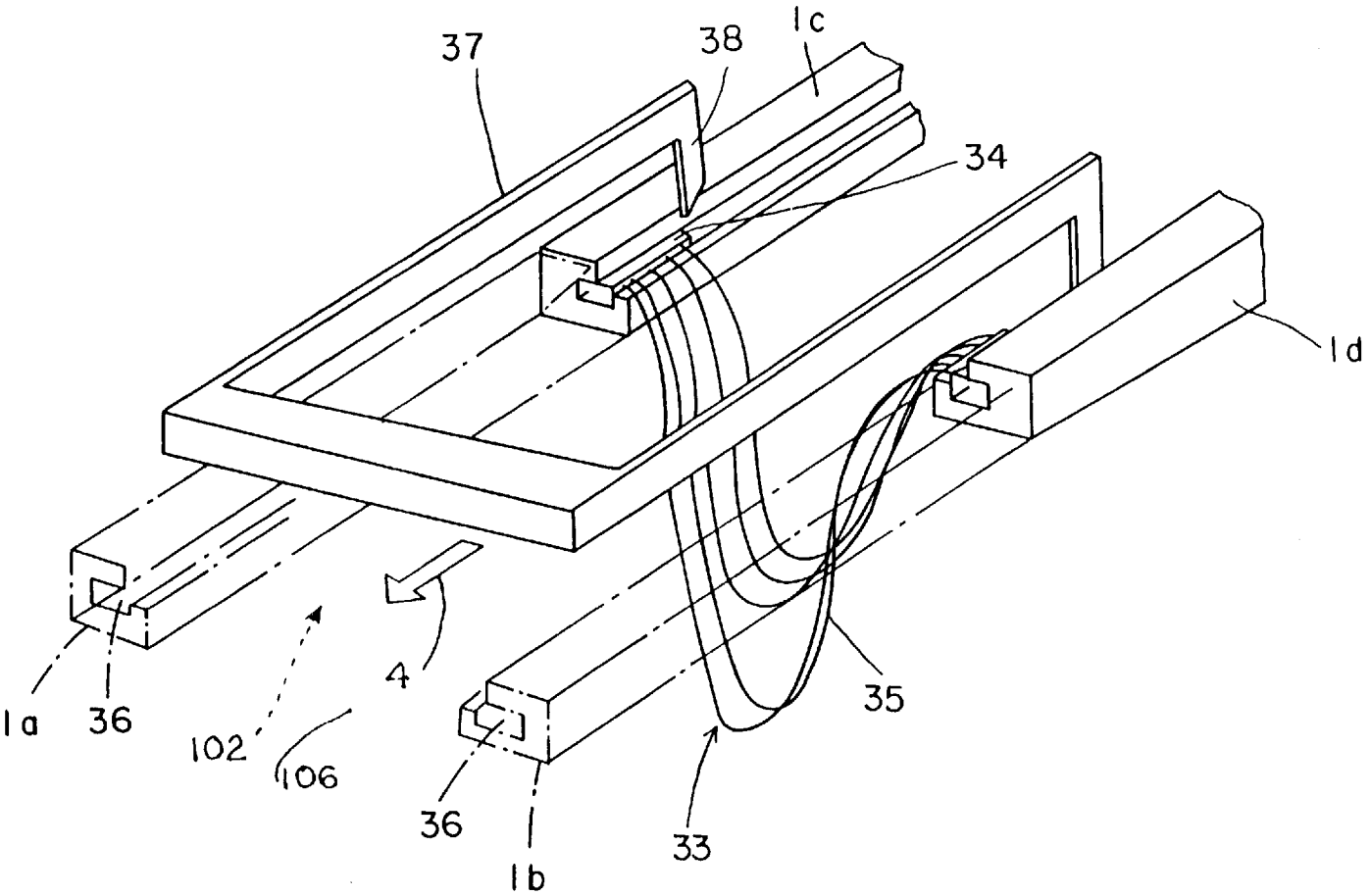
FIG. 2 is a perspective view of a wire harness entry unit which operates in association with the wire binding apparatus of FIG. 1.

In operation, an assembled wire harness is brought from a preceding and upstream assembly station (not shown, but located at the top center of FIG. 1 abutting the guide rails 1*a*, 1*b*) to the guide rails 1*a* and 1*b* of the wire-binding apparatus 100. The wire harness 33 is held in place, or sandwiched, between the opposing guide rails 1*a* and 1*b*, and carried in the general direction of the wire harness feedpath as indicated by arrow 4. (FIG.2.)

Figure 6:
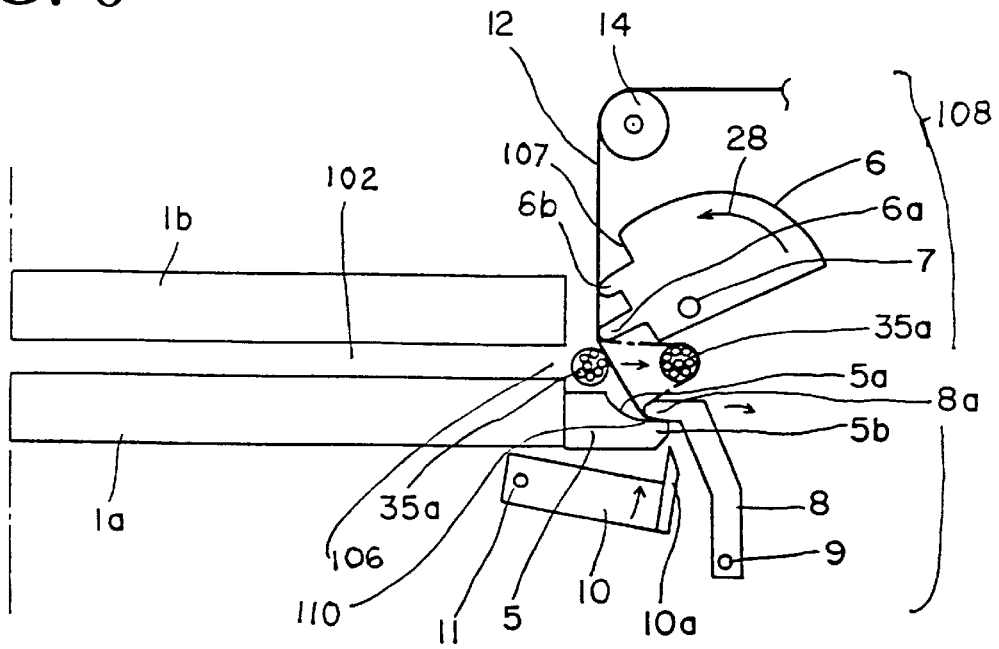
FIG. 6 is a plan view similar to FIGS. 4 & 5, but illustrating primarily a portion of the taping assembly utilized in the wire binding apparatus of FIG. 1 and showing how a collected bundle of wires of a harness is urged against a length of wire-binding tape.
Figure 7:
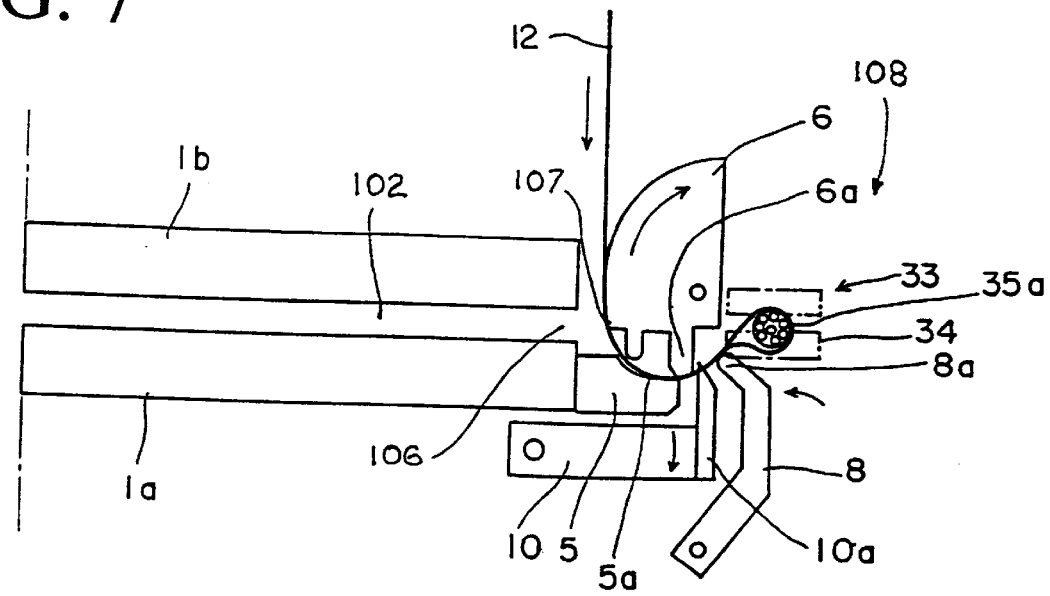
FIG. 7 is the same view as FIG. 6, but illustrating how the bundle of wires are bound by the tape.
Figure 8:
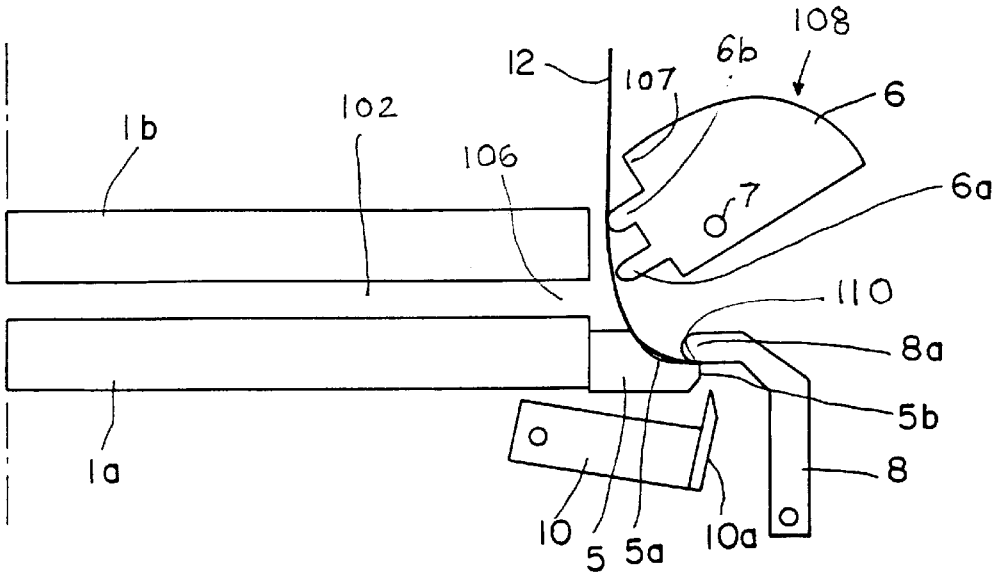
FIG. 8 is the same view as FIG. 6, illustrating how the components of the taping assembly return to their initial position for binding a subsequent bundle of wires together.

Focusing now generally on the central portion of FIG. 1 and the enlarged detail views of FIGS. 6–8, there is shown a taping assembly 108 which includes a tape support member 5 disposed at the exit 106 of the guide rails 1*a*, 1*b* and the wire harness feedpath. The tape support member 5 has a curved working surface 5*a* preferably aligned with and abutting one of the two guide rails 1*a*. A tape advancement member 6 is rotatably fixed to an axle 7 and includes a series of tape-contacting projections 6*a*, 6*b* disposed along its forward tape-engaging side 107 so that the projections 6*a*, 6*b* will confront the curved working surface 5*a* of the tape support member 5 during movement. Preferably, the tape advancement member 6 is spaced apart from the tape support member 5 in a manner so that the larger one 6*a* of the two projections 6*a*, 6*b* of the tape advancement member 6 may follow the contour of the curved working surface 5*a* of the tape support member 5 during operation of the apparatus 100. In this regard, the curved working surface 5*a* of the tape support member 5 acts as and provides a reaction surface for the tape advancement member 6 in order to facilitate advancement and application of the tape 12.

A tape catch lever 8 is located in the vicinity of the curved working surface 5*a* of the tape support member 5, and the tape catch lever 8 is rotatably mounted on a pivot 9 as shown, so that its free end 8*a* may contact the curved working surface 5*a* of the tape support member 5 when necessary to secure the end of tape 12 into position on the tape support member curved working surface 5*a* upon actuation of the taping assembly 108.

Turning now to FIG. 8, which is representative of an initial position of the taping assembly 108 of the wire-binding apparatus 100, it can be seen that the leading edge or end 110 of a length of wire-binding tape 12 is advanced along the curved working surface 5*a* of the tape support member 5. The tape 12 is positioned so that its leading edge 110 is secured between the end tip 5*b* of the tape support member working surface 5*a* and the free end 8*a* of the catch lever 8. This contact retains the tape 12 in place on the working surface 5*a* within the taping assembly 108 of the wire-binding apparatus 100.

As seen in FIG. 1, the wire-binding tape 12 is fed from a supply reel 13 of adhesive tape to the working surface 5*a* of the tape support member 5 across an intermediate guide roll 14. The tape 12 further extends across the projections 6*a*, 6*b* of the tape advancement member 6. Preferably, in this orientation, the adhesive surface of the tape 12 faces the working surface 5*a* of the tape support member 5.

Figure 3:
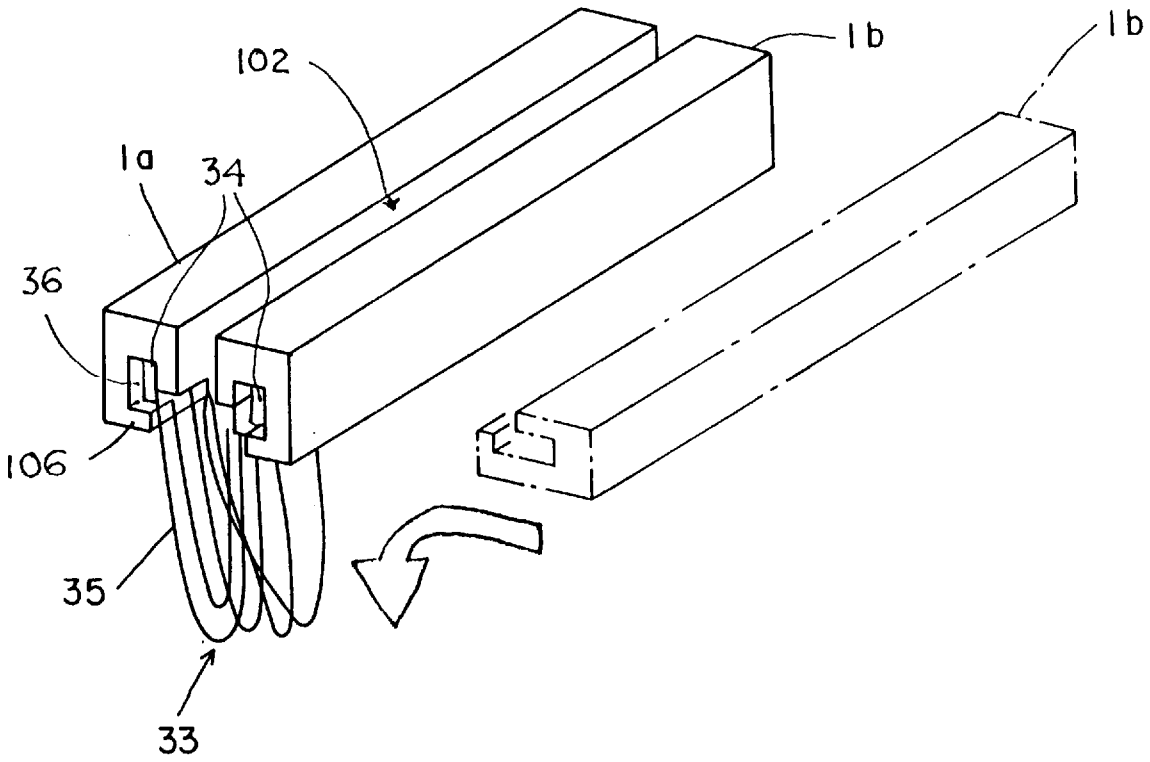
FIG. 3 is a perspective view illustrating the guide rails of the wire binding apparatus of FIG. 1 in their movement together and rotation thereof which brings the harness connector elements into close alignment with each other.
Figure 4:
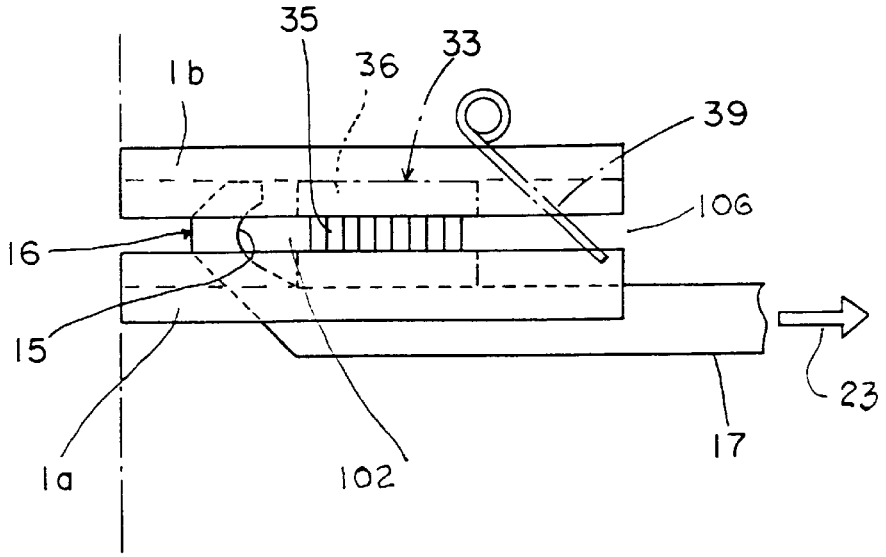
FIG. 4 is an enlarged plan view of a portion of the wire binding apparatus of FIG. 1, illustrating the wire loading assembly in a ready, or starting position.
Figure 5:
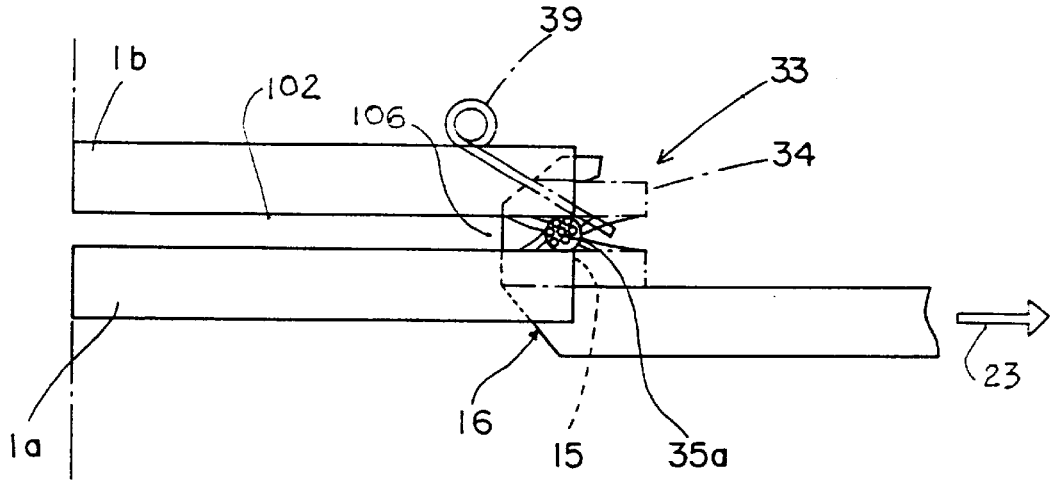
FIG. 5 is an enlarged plan view similar to FIG. 4 but illustrating the wire loading assembly collecting the wires of the wire harness at the ejection end of the guide rails after the wires have sagged down between the guide rails.

Turning specifically to FIGS. 4 & 5, the details of the wire collection aspect of the apparatus will now be discussed. As shown in the top center portion of FIG. 1, the wire-binding apparatus 100 includes a wire harness driving, or loading mechanism 16, which moves back and forth under the guide rail 1*a* in order to collect the wires 35 of the harnesses 33 together into a group of wires as the wire harness 33 enters the wire-binding apparatus 100. The wires are collected so that their axes are oriented generally vertically (i.e., out of the plane of the paper in FIG. 5) as shown in FIG. 3. Not only does this loading mechanism 16 gather the wires 35 as illustrated, but it also drives the wire harness 33 through the feedpath defined by the guide rails 1*a*, 1*b* and their associated wires into contact with the tape 12. In effect, it loads the gathered wires into the taping assembly 108.

This driving mechanism 16 includes a drive member 17 having a generally "J" or hook-like configuration. The drive member 17 is mounted on a pair of rollers 18 (FIG. 1) received within a corresponding slot 20 formed in a base plate 19 of the apparatus 100 so that it may reciprocate in order to perform its driving movement. It preferably includes a curved, or hooked end 15, which is located beneath and preferably centered between the wire harness guide rails 1*a*, 1*b*. The hooked end 15 of the drive member 17 is spaced apart from the body portion 17*b* of the drive member and is connected thereto by way of an angled portion 17*a*. The drive member 17 of the tape loading mechanism 16 is driven in its movement along the direction indicated by arrow 23 under the power of a piston-cylinder assembly 22 mounted to the wire-binding apparatus 100 at one end and at the other end to an arm 21 extending from the drive member 17.

The tape loading mechanism 16, and particularly the movement of the drive member 17 thereof, serves to actuate all of the taping components of the wire-binding apparatus 100. Specifically, it causes rotation of the tape advancement member 6, the catching and release of the tape catch lever 8 and the cutting and withdrawal of the tape cutter 10 in unison with each other. This synchronized movement is facilitated by means of a drive lever 25 (FIG. 1) mounted on the apparatus 100 in an engagement path with the drive lever 17.

As seen best in FIG. 1, the drive lever 25 is rotatably mounted on the wire-binding apparatus 100 at a pivot pin 24. One end 25*a* of the drive lever 25 is in the path of the drive member 17 and confronts the guide roller 18 of the body portion 17*b* of the drive member 17 so that the two engage each other when the drive member 17 moves within its travel slot 20. The tape catch lever 8 is also operatively associated with the drive member 17 because the catch lever 8 is rotatably mounted to the apparatus 100 at pivot pin 9 and has a pin 26 extending therefrom which engages an edge of the angled section 17*a* of the drive member 17.

In operation, the end 25*a* of the drive lever 25 which confronts the guide roll 18 causes the drive lever 25 to rotate around its pivot pin 24 in the direction indicated by arrow 27, when contacted by the drive member. This contact rotates the tape advancement member 6 around its pivot point 7 in the direction indicated by arrow 28 which, as illustrated, parallels its outer curved surface. On the other side of the centerline of the travel path of the wire harnesses 33 through the guide rails 1*a*, 1*b*, the angled section 17*a* of the drive member 17 contacts and pushes the pin 26 of the tape catch lever in the direction indicated by arrow 29. This contact causes a rotation and withdrawal of the tape catch lever 8, as well as a further rotation and advancement of the tape cutter 10. Thereafter, the drive member 17 returns to its initial position under the influence of a spring 30.

A tape perforating unit 31 may also be utilized with the present invention and is shown in FIG. 1 as opposing the adhesive side of the tape 12. A tape perforation support plate 32 is placed on the non-adhesive side of the adhesive tape 12 which extends between the tape reel 13 and the intermediate guide drive roll 14 in opposition to the perforating unit 31 in order to provide a reaction surface for the knives of perforating unit 31 to contact.

The manner in which the wires 35 of an electric connector harness 33 are bound together shall now be described. FIGS. 2 & 3 show that the opposing connector elements 34 of an assembled wire harness 33 are brought together with the aid of the guide rails 1*a* and 1*b*. The guide rails 1*a*, 1*b* are then rotated 90° by their support arms 140 in order to effect a proper sagging of the wires 35. FIGS. 4 & 5 show how the wires 35 of the wire harness 33 are collected together by the loading mechanism 16. Finally, FIGS. 6–8 show the manner in which the wire-binding tape 12 is wound around the bundle of the wires 35 of the wire harness 33.

As shown in FIG. 2, a wire harness 33 is transferred from a set of ejection guide rails 1*c* and 1*d* of a preceding wire harness assembly machine and into the entryway 102 of the wire-binding apparatus, defined by the guide rails 1*a* and 1*b*, with the aid of a harness feed member 37 which reciprocates in a direction parallel to rails 1*a* and 1*b*. The longitudinal slots of the ejection guide rails 1*c* and 1*d* of the preceding assembly machine are aligned with the longitudinal slots of their counterpart guide rails 1*a* and 1*b* of the wire-binding apparatus 100. Once aligned, the opposing connector elements 34 of the wire harness 33 are engaged by the hooks 38 of the harness feed unit 37. (FIG. 2.) Each wire harness 33 is then transferred from the ejection guide rails 1*c* & 1*d* of the harness assembly machine to the guide rails 1*a* and 1*b* by movement of the harness feed unit 37 in the direction indicated by arrow 4.

As shown in FIG. 3, the ejection guide rails 1*a* and 1*b* of the wire-binding apparatus are then rotated about their longitudinal axes, approximately 90° in order to reorient the openings of their connector element-receiving slots 36 generally downwardly as illustrated. The guide rails 1*a* & 1*b* are then drawn toward each other, the guide rail 1*a* being held stationary while the other guide rail 1*b* is advanced toward it in the embodiment shown. When so moved together and rotated, the wires 35 of the wire harness 33 hang, or droop, downwardly in a U-shaped form as illustrated.

Referring now to FIG. 4, the tape driving and loading mechanism 16 then moves toward the entryway 102 so that its hooked end 15 engages the hanging wires 35 of the wire harnesses 33. As seen in FIGS. 4 & 5, a return spring 39 is mounted proximate the exit end of the closed guide rails 1*a*, 1*b* as shown in phantom and cooperates with the hooked end 15 of the tape loading mechanism 16 to assure that the wires 35 of the wire harness 33 are gathered tightly together in a bundle below the level of their respective opposing connector elements 34.

The tape advancement member 6, the tape catch lever 8 and the tape cutter 10 then are operated in unison with the tape loading mechanism 16 in order to bind the wires and thereafter eject the bound wire harness 33. (FIGS. 6–8.) First, the bundle of the wires 35*a* is brought into contact with the adhesive side of the adhesive tape 12 as the tape advancement member 6 is aligned with the exit 106 of the two guide rails 1*a*, 1*b*. In this position, the projections 6*a*, 6*b* of the tape advancement member do not project into the exit 106 of the entryway 102. Then, the wire bundle 35*a* and the adhesive tape 12 are moved together so that the adhesive tape 12 may be applied to the circumference of the wire bundle.

Further advancement of the wire harness 33 causes the tape advancement member 6 to rotate by virtue of the actuating end 114 of the drive member 17 impinging upon the actuating end 115 of the taping assembly drive lever until the projections 6*a* of the tape advancement member 6 extend past the exit 106 of the entryway 102 and confront the concave working surface 5*a* of the tape support member 5. This orients the adhesive sides of the wire-binding tape 12 around the wire bundle 35*a* and onto each other to complete the taping of the wire bundle. The tape catch lever 8 then withdraws from contact with the concave working surface 5*a* of the tape support member 5, and the tape cutter 10 subsequently advances as shown to cut and separate the taped bundle 35*a* from the remaining length 12 of wire-binding tape. The drive lever 25 includes a cam surface 116 near its actuating end 115 which causes portion 25*b* of drive lever 25 to move upwardly in FIG. 1 (or toward the wire harness feedpath) in response to movement of the driving member 17. This movement causes the tape advancement member 6 to rotate around it pivot pins 7.

The leading edge 110 of this tape length is then applied to the concave working surface 5*a* of the tape support member 5. FIG. 8 illustrates how the leading edge 110 of the subsequent tape length 12 is again sandwiched between the concave working surface 5*a* of the tape support member 5 and the free end 8*a* of the tape end catch lever 8 for the taping the wires of a subsequent wire harness 33. It therefore adopts its standby or initial position.

Once the wire harness 33 has its wires 35 bound together as a group, it is pushed and thereupon falls into an opening 40 of the base plate 19 of the wire-binding apparatus which lies downstream of and just below the exit end of the ejection guide rails 1*a* and 1*b*. (FIG. 1.) The perforating unit 31 operates by way of a controller (not shown) to perforate the adhesive tape 12 transversely at regular intervals, thereby facilitating the removal of the tape from the bound wire bundle of the wire harnesses at an end installation where the wire harnesses are installed into a component.

As may be understood from the above, the wires 35 of the wire harnesses 33 can be automatically bound without fear of entanglement and without regard to the length of the various wires, thereby saving the labor and increasing the efficiency of production.

Also, the wires of sequential wire harnesses passing through the apparatus are advantageously bound together as individual harness, and therefore, no wire tangling is likely to occur between assembled wire harnesses even if collected together, thereby accordingly facilitating the handling of such wire harness in subsequent stages. Wire harnesses having wires of different lengths can be equally handled in binding and the use of adhesive tapes of different colors is advantageous to distinction of wire harnesses in terms of lots, which different colors are allotted to.

It will be appreciated that the embodiments of the present invention discussed herein are merely illustrative of a few applications of the principles of the invention. Numerous modifications may be made by those skilled in the art without departing from the true spirit and scope of the invention.

We claim:

1. A wire-binding apparatus for binding wires of a wire harness together, the wires of the harness having two opposing ends, said wires being terminated at their opposing ends to respective opposing connector elements, the wire-binding apparatus comprising:

a wire harness feedpath for receiving the wire harness and guiding said wire harness into said wire-binding apparatus, the wire harness feedpath having entry and exit ends, the wire harness feedpath exit end extending to a tape application location within said wire-binding apparatus, said wire harness feedpath receiving said harness opposing connector elements in generally horizontal alignment with each other, said wire harness feedpath including an open space disposed between said opposing connector elements, said wires depending across the feedpath open space and sagging below the connector elements;

driving means for collecting said wires in said wire harness feedpath into a group and driving the group of wires through said wire harness feedpath to said exit end thereof;

tape feed means for feeding a preselected length of binding tape from a tape supply into a registration position within said wire-binding apparatus in opposition to said entryway, wherein the length of tape is generally disposed crosswise with respect to said group of wires, said driving means driving said group of wires into contact with said length of tape around said wires to bind said wires together; and, tape cutting means for cutting said length of tape after being applied around said group of wires.

2. A wire harness binding apparatus as set forth in claim 1, wherein said entryway includes two opposing guide rails separated by said open space, each rail having a slot which receives one of said wire harness opposing connector elements, one of said two guide rails being movable relative to the other guide rail, whereby, when said one guide rail is moved toward said other guide rail, said wires of said wire harness depend down into said open space.

3. A wire harness binding apparatus as set forth in claim 2, wherein said tape feed means is operatively connected to said wire driving means.

4. A wire harness binding apparatus as set forth in claim 3, wherein said tape application means includes a tape advancement member rotatably mounted proximate to said exit end of said wire harness feedpath, the tape advancement member having at least one tape-contacting surface which contacts said length of tape and applies it around said group of wires.

5. A wire harness binding apparatus as set forth in claim 4, wherein said tape advancement member has two protrusions extending therefrom in a plane generally transverse to an axis of said group of wires, the two tape advancement member protrusions forming two tape-contacting surfaces thereon.

6. A wire harness binding apparatus as set forth in claim 2, wherein said guide rails include opposing wire harness connector element receiving slots oriented generally horizontally with respect to said wire-binding apparatus, said guide rails further being capable of at least limited rotation about their longitudinal axes so as to permit said guide rails to move and reorient their wire housing connector receiving slots and said wires terminated thereto generally vertically with respect to said wire-binding apparatus such that said wires depend vertically down into said open space.

7. A wire harness binding apparatus as set forth in claim 1, further including tape application means for applying said length of tape around said group of wires after said driving means has driven said group of wires into contact with said length of tape.

8. A wire harness binding apparatus as set forth in claim 7, wherein said tape application means includes a tape advancement member rotatably mounted proximate to said wire harness feedpath exit end, a tape catch member pivotally mounted proximate to said wire harness feedpath and a tape working surface aligned with said wire harness feedpath exit end.

9. A wire harness binding apparatus as set forth in claim 8, wherein said tape working surface is curved and said length of tape is advanced into place on said working surface by rotation of said tape advancement member, said tape advancement member including at least one tape-contacting surface extending outwardly therefrom which at least partially contacts said working surface during rotation of said tape advancement member, said working surface providing a reaction surface to said tape advancement member to facilitate advancement of said tape length and application of said tape length around said group of wires.

10. A wire harness binding apparatus as set forth in claim 1, wherein said driving means includes an elongated hooked member slidably disposed on said wire-binding apparatus and aligned with a centerline of said wire harness feedpath, said hooked member having an actuating end and said tape feed means having an actuating end, said hooked member and tape feed means actuating ends being aligned with each other wherein movement of said hooked member in collecting and driving said wires through said feedpath causes said hooked member actuating end to impinge upon said tape feed means actuating end, thereby causing said tape feed means to apply said tape length around said group of wires.

11. A wire harness work station for taping wires of wire harnesses together, wherein the wire harnesses include a plurality of elongated wires having opposing ends and connector elements terminated to the wire opposing ends, the wire harness work station comprising: guide means for supporting said wire harnesses in a manner wherein said harness connector elements are aligned together at a predetermined level within said work station and said wires of said wire harnesses extend between said opposing connector elements and sag beneath said predetermined level; advancement and gathering means disposed beneath said predetermined level for advancing said wire harnesses along said guide means and through a exit of said guide means and for gathering said wires of said wire harnesses into a group ready for taping beneath said predetermined level; a tape supply; tape feed means for feeding a length of tape from said tape supply along a tapepath generally transverse to said guide means and to said group of wires, a tape application member disposed along said tapepath and proximate to the guide means exit, the tape application member being moveable between a first operative position wherein said tape application member is aligned with said guide means exit and a second operative position wherein said tape application member extends across said guide means exit, said tape application member engaging said length of tape advanced by said tape feed means, said tape application member having at least one tape-contacting member defined thereon, the tape-contacting member being displaceable with movement of said tape application member such that said tape-contacting member may be rotated into contact within said tape to thereby apply said tape to said group of wires beneath said predetermined level; and, severing means for severing said tape after application thereof to said group of wires.

12. The wire harness work station as defined in claim 11, wherein said guide means includes two opposing, spaced-apart guide rails which form a pathway which guide said wire harnesses toward said tape application means, said guide rails receiving said harness connector elements therein and supporting said wires terminated to said connector elements at said predetermined level, one of said guide rails being movable towards the other side of said guide rails to thereby permit portions of said wires to depend down between said guide rails and beneath said predetermined level.

13. The wire harness work station as defined in claim 12, further including a tape support member disposed proximate to and aligned with one of said guide rails, said tape support member providing a support surface for said tape when said tape application member is in said first operative position and providing a reaction surface for said tape application member when said tape application member is in said second operative position.

14. The wire harness work station as defined in claim 13, further including a catch member which selectively contacts said tape support member to retain said tape thereon when said tape application member is in said first operative position and said catch member being moved out of contact with said tape support member when said tape application member is in said second operative position.

15. The wire harness work station as defined in claim 11, wherein said tape extends transversely across said guide means exit beneath said predetermined level and transversely to a longitudinal axis of said group of wires, whereby, when said advancement and gathering means gathers said group of wires and advances said group of wires into contact with said tape, said tape application member moves to said second operative position and folds said tape around said group of wires and upon itself.

16. The wire harness work station as defined in claim 15, wherein said guide means includes a pair of guide rails spaced apart from each other, and said work station further includes: a tape support member disposed proximate to said guide means exit, said tape support member providing a support surface for said tape when said tape application member is in said first operative position and providing a reaction surface for said tape application member when said tape application member is in said second operative position; a catch member which engages said tape support member to retain said tape thereon when said tape advancement member is in said first operative position and which disengages said tape support member to release said tape when said tape application member moves to said second operative position; and, said tape application member and catch member are operatively associated with said advancement and gathering means, whereby as said group of wires is advanced into contact with said tape, said tape application member moves to said second operative position to fold said tape around said group of wires and upon itself.

17. The wire harness work station as defined in claim 11, wherein said guide means includes first and second opposing, spaced-apart guide rails which form a pathway which guide said wire harnesses toward said tape application means, at least said first guide rail being movable with respect to said second guide rail, said first and second guide rails each having a longitudinal slot disposed therein at said predetermined level which receives said wires of said wire harnesses, said guide means including means for moving said first and second guide rail slots from a first position to a second position wherein said first and second guide rail slots are disposed beneath said predetermined level.

18. The wire harness work station as defined in claim 17, wherein said first guide rail is movable relative to said second guide rail in a direction generally transverse with respect to said longitudinal axes of said group of wires and said first and second guide rail slot moving means moves said first and second guide rail slots about an axis that is generally transverse with respect to said longitudinal axes of said group of wires.

19. The wire harness work station as defined in claim 11, wherein said advancement and gathering means includes a drive arm reciprocatable along a line of action of said work station and said tape application member includes an actuating arm interposed in the line of action of said advancement and gathering means drive arm, whereby, as said advancement and gathering means gathers said group of wires and advances said group of wires along said guide means, said gathering means drive arm impinges upon said tape application member actuating arm to move said tape application member from said first to said second operative positions.

20. The wire harness work station as defined in claim 11, wherein said tape is applied to said group of wires of said wire harnesses near said connector elements thereof and beneath said predetermined level.

21. A wire-binding apparatus for binding wires of a wire harnesses together, the wire harnesses including a plurality of elongated wires having two opposing ends that are terminated to respective first and second connector elements, the wire-binding apparatus comprising:

a wire harness feedpath for providing a pathway directing said wire harnesses into said wire-binding apparatus, the wire harness feedpath being defined in part by first and second guide rails that are spaced apart from each other to define an intervening space therebetween, the first and second guide rails respectively receiving said first and second connector elements therein such that said harness wires extend between said first and second guide rails across said intervening space at said predetermined level, said wire harness feedpath having an exit that confronts a tape application location within said wire-binding apparatus, at least said first guide rail being moveable toward said second guide rail such that when said first guide rail moves toward said second guide rail, said harness wires sag and depend down into said feedpath intervening space in a wire collection position, said apparatus further including means for moving said first and second guide rails about respective first and second axes thereof to orient said harness wires in a vertical position with respect to said wire harness feedpath such that said harness wires extend beneath said predetermined level;

driving means for collecting said harness wires of a wire harness in said wire harness feedpath together into a group and driving the group of harness wires through said wire harness feedpath exit end thereof;

tape feed means for feeding a preselected length of binding tape from a tape supply along a tapepath generally disposed crosswise with respect to said group of harness wires, said driving means driving said group of wires into contact with said tape length around said wires to bind said wires together; and, tape cutting means for cutting said length of tape after being applied around said group of wires.

* * * * *